US011167393B2

(12) United States Patent
Sekiya et al.

(10) Patent No.: US 11,167,393 B2
(45) Date of Patent: Nov. 9, 2021

(54) CUTTING BLADE AND MOUNTING MECHANISM FOR CUTTING BLADE

(71) Applicant: DISCO CORPORATION, Tokyo (JP)

(72) Inventors: Kazuma Sekiya, Tokyo (JP); Yuichiro Matsumi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 376 days.

(21) Appl. No.: 16/059,269

(22) Filed: Aug. 9, 2018

(65) Prior Publication Data

US 2019/0054596 A1 Feb. 21, 2019

(30) Foreign Application Priority Data

Aug. 15, 2017 (JP) ..... JP2017-156821

(51) Int. Cl.
*B24D 5/12* (2006.01)
*B24D 5/16* (2006.01)

(52) U.S. Cl.
CPC ..... *B24D 5/12* (2013.01); *B24D 5/16* (2013.01)

(58) Field of Classification Search
CPC ..... B24B 23/022; B24B 27/02; B24B 45/00; B28D 1/04; B28D 5/022; B24D 5/12; B24D 5/16; B24D 5/02; B24D 7/16
USPC ..... 451/541, 41, 359; 125/13.01, 15
See application file for complete search history.

(56) References Cited

U.S. PATENT DOCUMENTS 1,788,634 A * 1/1931 Robinson ..... B24D 5/16 451/342
2,398,664 A * 4/1946 Paul ..... B24B 45/00 451/342
2,454,726 A * 11/1948 Tott ..... B24D 9/085 451/511
2,497,217 A * 2/1950 Hall ..... B24B 45/00 451/342
2,818,694 A * 1/1958 Tocci-Guilbert ..... B24D 5/02 451/536
3,036,412 A * 5/1962 Tocci-Guilbert ..... B24B 45/00 451/342
3,340,652 A * 9/1967 Purcell, Jr. ..... B24D 9/085 451/508
3,376,675 A * 4/1968 Hutchins ..... B24D 9/085 451/508
3,596,415 A * 8/1971 Donahue, Jr. ..... B24B 45/00 451/510
3,886,925 A * 6/1975 Regan ..... B23D 61/10 125/15

(Continued)

FOREIGN PATENT DOCUMENTS

JP 2006218571 A 8/2006

*Primary Examiner* — Joseph J Hail
*Assistant Examiner* — Jonathan R Zaworski
(74) *Attorney, Agent, or Firm* — Greer Burns & Crain Ltd.

(57) ABSTRACT

A cutting blade is mounted on a fixed flange having a cylindrical blade mounting portion. The cutting blade includes an annular blade main body having an outer circumference serving as a cutting edge and a central through-hole that has a diameter greater than an outer diameter of the blade mounting portion and in which the blade mounting portion is to be fitted, and three or more flexible inner circumferential protrusions that project from an inner circumference of the central through-hole toward the center in a diametrical direction and contact at extremities thereof with the blade mounting portion fitted in the central through-hole to support the annular blade main body.

8 Claims, 6 Drawing Sheets

(56) References Cited

U.S. PATENT DOCUMENTS 4,622,783 A * 11/1986 Konig ..... B24D 9/085 451/508
4,729,193 A * 3/1988 Gant ..... B24B 45/006 409/231
4,754,577 A * 7/1988 MacKay, Jr. ..... B24D 5/16 15/230.18
4,870,688 A * 9/1989 Voroba ..... H04R 25/609 381/60
4,878,316 A * 11/1989 MacKay, Jr. ..... B24D 5/16 451/342
5,651,726 A * 7/1997 Skogsberg ..... B24B 23/02 408/239 R
5,754,991 A * 5/1998 Drozdowich ..... A47B 77/06 4/631
6,012,977 A * 1/2000 Yoshikawa ..... B24D 5/12 125/15
6,042,461 A * 3/2000 Pearson ..... B23D 45/006 451/342
7,192,338 B2 * 3/2007 Kausch ..... B24B 45/00 451/358
7,588,484 B2 * 9/2009 Momosaki ..... B24B 45/006 451/359
7,621,801 B2 * 11/2009 Himmelsbach ..... B24B 45/00 451/342
8,029,341 B2 * 10/2011 Belly ..... B24B 45/006 451/360
8,408,974 B2 * 4/2013 Farber ..... B24B 45/00 451/342
9,321,148 B2 * 4/2016 Huber ..... B24D 5/16
9,796,064 B2 * 10/2017 Holiness-Stalling ... B24B 45/00
2003/0001064 A1 * 1/2003 Book ..... G09F 1/103 248/460
2003/0032384 A1 * 2/2003 Terada ..... B24D 3/28 451/541
2007/0167119 A1 * 7/2007 Momosaki ..... B24D 5/16 451/359
2008/0248733 A1 * 10/2008 Mueller ..... B24B 45/003 451/340
2008/0306432 A1 * 12/2008 Kumagai ..... H01L 21/67092 604/22
2016/0059370 A1 * 3/2016 Matsuyama ..... B23D 59/025 409/136

* cited by examiner

CUTTING BLADE AND MOUNTING MECHANISM FOR CUTTING BLADE

BACKGROUND OF THE INVENTION

Field of the Invention

The present invention relates to a cutting blade and a mounting mechanism for a cutting blade.

Description of the Related Art

An annular cutting blade that is fixed to a distal end of a spindle through a fixed flange is known. The cutting blade is formed such that abrasive grains such as diamond abrasive grains are fixed thereto with bonds. While the cutting blade rotates at a high speed, it cuts into a workpiece to perform a crushing process, whereupon the cutting blade exhausts itself to perform spontaneous edge sharpening such that sharpness is maintained while processing is performed.

The cutting blade mounted on the spindle is placed, at an initial stage when it is fixed to a distal end of the spindle, in a one-sided condition in which only part of an outer circumference thereof can perform a cutting process because the position of the center of rotation of the spindle and the position of the center of the cutting blade are displaced from each other. Therefore, after the cutting blade is fixed to a distal end of the spindle, a perfect circle establishing step for forcibly exhausting the cutting edge of the cutting blade by dressing thereby to align the position of the center of rotation of the spindle and the position of the center of the cutting edge on the outer edge of the cutting blade with each other is carried out (for example, refer to Japanese Patent Laid-Open No. 2006-218571).

SUMMARY OF THE INVENTION

According to the method disclosed in Japanese Patent Laid-Open No. 2006-218571, a dressing board is prepared in order to carry out the perfect circle establishing step before cutting of a workpiece after the cutting blade is mounted on the spindle, and there is a tendency that the amount by which the cutting blade is forcibly exhausted in the perfect circle establishing step increases.

Therefore, it is an object of the present invention to provide a cutting blade and a mounting mechanism for a cutting blade by which the amount by which the cutting blade can be forcibly exhausted before cutting of a workpiece after the cutting blade is mounted on a spindle can be suppressed.

In accordance with an aspect of the present invention, there is provided a cutting blade of an annular shape for being mounted on a fixed flange having a cylindrical blade mounting portion fixed to a distal end of a spindle, including an annular blade main body having an outer circumference serving as a cutting edge and a central through-hole that has a diameter greater than an outer diameter of the blade mounting portion and in which the blade mounting portion is to be fitted, and three or more flexible inner circumferential protrusions that project from an inner circumference of the central through-hole toward the center in a diametrical direction and contact at extremities thereof with the blade mounting portion fitted in the central through-hole to support the blade main body, in which, as viewed in plan, a circle interconnecting the extremities of the inner circumferential protrusions and a circle defined by an outer circumference of the blade main body are formed concentrically, and when the cutting blade is to be mounted on the fixed flange, the inner circumferential protrusions are deformed by pressure contact with the blade mounting portion into which the cutting blade is fitted to allow the fitting of the cutting blade with the blade mounting portion.

Preferably, the blade main body is configured from an abrasive grain layer in which abrasive grains are fixed by bond, and the inner circumferential protrusions are formed from a bond layer that does not include abrasive grains.

In accordance with another aspect of the present invention, there is provided a mounting mechanism for a cutting blade that includes an annular blade main body having an outer circumference serving as a cutting edge and a central through-hole, and three or more flexible circumferential protrusions formed integrally with the annular blade main body and projecting from an inner circumference of the central through-hole toward the center in a diametrical direction, the mounting mechanism including a fixed flange including a blade mounting portion fixed to a distal end of a spindle of a cutting apparatus and having a male thread on an outer circumference thereof and a flange portion formed integrally with the blade mounting portion behind the blade mounting portion, a removable flange configured to be mounted on the blade mounting portion so as to cooperate with the flange portion of the fixed flange to sandwich therebetween a cutting blade mounted on the blade mounting portion of the fixed flange, and a fixation nut configured to be screwed with the male thread of the fixed flange such that the cutting blade is sandwiched and fixed between the flange portion of the fixed flange and the removable flange, in which, if the fixation nut is screwed with the male thread of the fixed flange and is tightened, then the inner circumferential protrusions are pressed against and deformed by the blade mounting portion and the annular blade main body is supported by the inner circumferential protrusions.

With the invention of the present application, an advantageous effect that the amount by which the cutting blade is exhausted forcibly before cutting of a workpiece after the cutting blade is mounted on the spindle can be suppressed is achieved.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

A mode for carrying out the present invention is described in detail with reference to the drawings. The present invention shall not be restricted by the substance of the following description of embodiments. Further, the components described below include those that can be supposed readily by those skilled in the art and those that are substantially same. Furthermore, the configurations described below can be combined suitably. Further, various omissions, replacements or changes of the components can be performed without departing from the subject matter of the present invention.

First Embodiment

A cutting blade and a mounting mechanism for a cutting blade according to the first embodiment are described with reference to the drawings. A cutting blade 1 and a mounting mechanism 10 for a cutting blade (hereinafter referred to simply as mounting mechanism) according to the first embodiment configure a cutting apparatus 100 depicted in FIG. 1. The cutting apparatus 100 is an apparatus for cutting a workpiece not depicted. In the first embodiment, the workpiece to be cut by the cutting apparatus 100 is a wafer such as a semiconductor wafer or an optical device wafer of a disk type made of a base material such as, for example, silicon, sapphire or gallium. The wafer as a workpiece has devices formed in regions thereof partitioned by a plurality of scheduled division lines formed in a lattice pattern on a flat surface thereof. Further, the cutting apparatus 100 depicted in FIG. 1 may cut, as a workpiece, a package substrate, a ceramic plate, a glass plate or the like of a rectangular shape having a plurality of devices sealed in resin therein.

Figure 1:
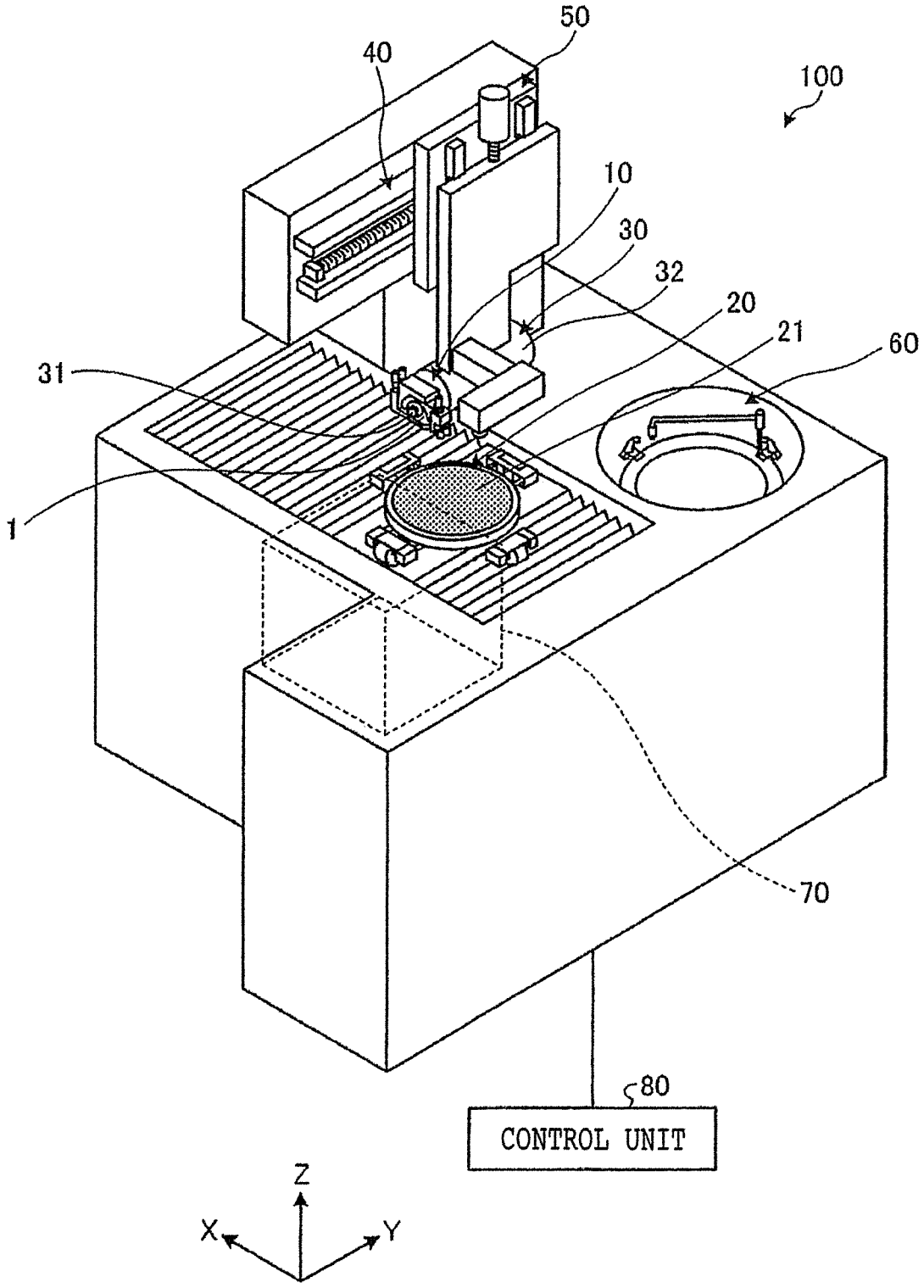
FIG. 1 is a perspective view depicting an example of a configuration of a cutting blade and a cutting apparatus including a mounting mechanism for a cutting blade according to a first embodiment.

As depicted in FIG. 1, the cutting apparatus 100 includes a chuck table 20 rotatable around an axis of rotation thereof by a rotational driving source and having a holding face 21 that sucks and holds a workpiece thereon, a cutting unit 30 for cutting (processing) a workpiece held on the chuck table 20 using the cutting blade 1, an X-axis moving unit not depicted that moves the chuck table 20 in an X-axis direction, a Y-axis moving unit 40 for moving the cutting unit 30 in a Y-axis direction, and a Z-axis moving unit 50 for moving the cutting unit 30 in a Z-axis direction. The cutting apparatus 100 further includes a washing unit 60 for washing a workpiece after cutting, a cassette 70 for accommodating a workpiece therein before and after cutting, a transport unit not depicted for transporting a workpiece between the cassette 70, chuck table 20 and washing unit 60, and a control unit 80 that is a computer for controlling the components.

In the cutting apparatus 100, while cutting water is supplied from the cutting unit 30 to the workpiece, the chuck table 20 and the cutting unit 30 are moved relatively along a scheduled division line to and from the X-axis moving unit, rotational driving source, Y-axis moving unit 40 and Z-axis moving unit 50 such that the scheduled division line of the workpiece is cut by the cutting blade 1 that is rotated by a spindle 31 of the cutting unit 30. After the cutting apparatus 100 cuts all scheduled division lines of the workpiece, it accommodates the workpiece into the cassette 70 after it washes the workpiece by the washing unit 60.

Figure 2:
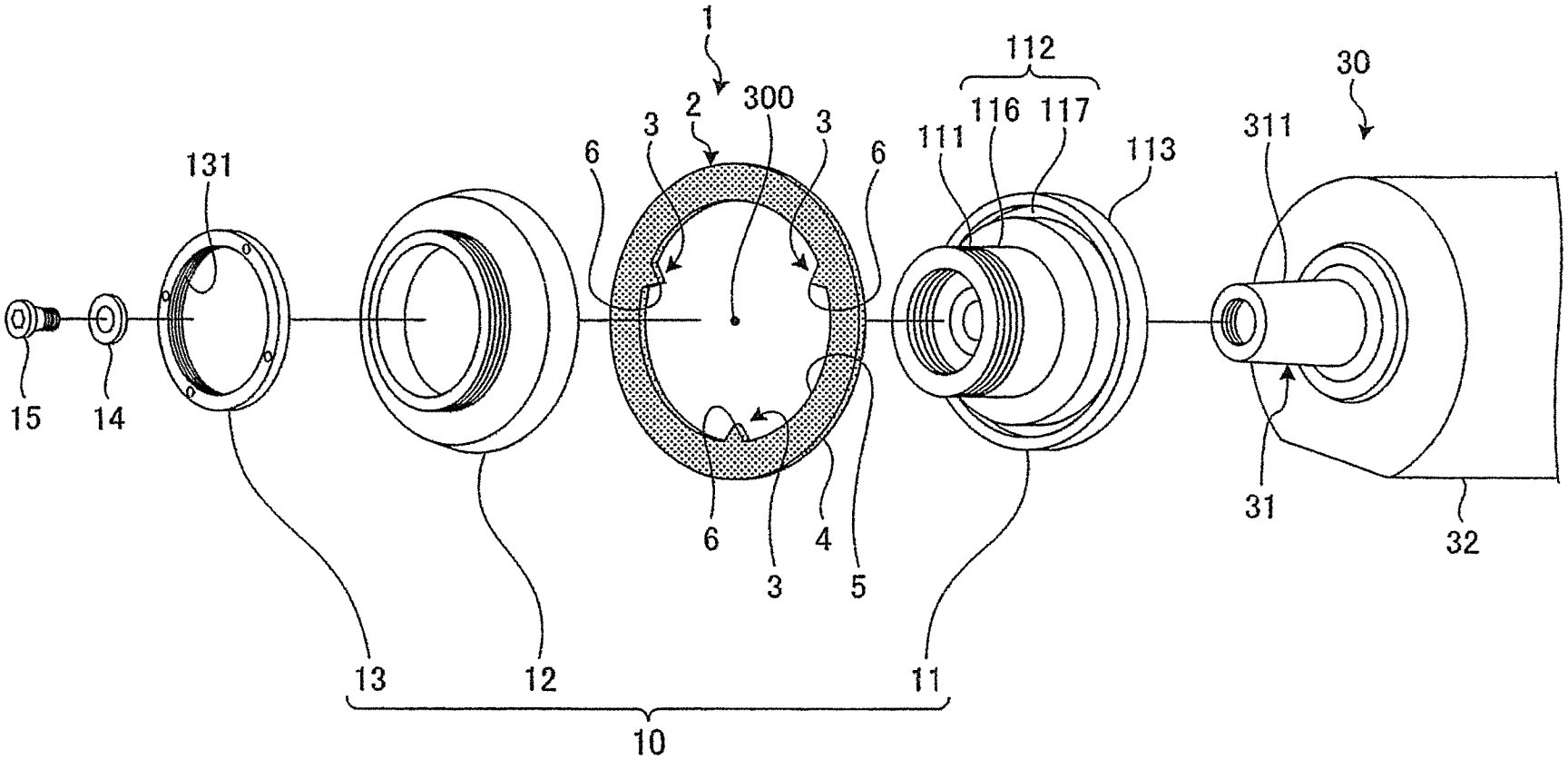
FIG. 2 is a perspective view fragmentarily depicting the mounting mechanism for a cutting blade according to the first embodiment.

As depicted in FIG. 2, the cutting unit 30 of the cutting apparatus 100 includes a spindle housing 32 provided for movement in the Y-axis direction and the Z-axis direction by the Y-axis moving unit 40 and the Z-axis moving unit 50, respectively, and the spindle 31 provided for rotation around the axis of rotation extending in parallel to the Y-axis direction in the spindle housing 32. Further, the cutting unit 30 includes the cutting blade 1 fixed to a distal end 311 of the spindle 31, and a mounting mechanism 10 for mounting the cutting blade 1 on the distal end 311 of the spindle 31.

The spindle 31 is supported for rotation on the spindle housing 32. The distal end 311 of the spindle 31 projects outwardly from one end portion of the spindle housing 32. To a proximal end portion of the spindle 31, a motor (not depicted) for rotating the spindle 31 is connected. The distal end 311 of the spindle 31 is formed tapering such that the outer diameter thereof gradually decreases toward the extremity thereof.

Figure 3:
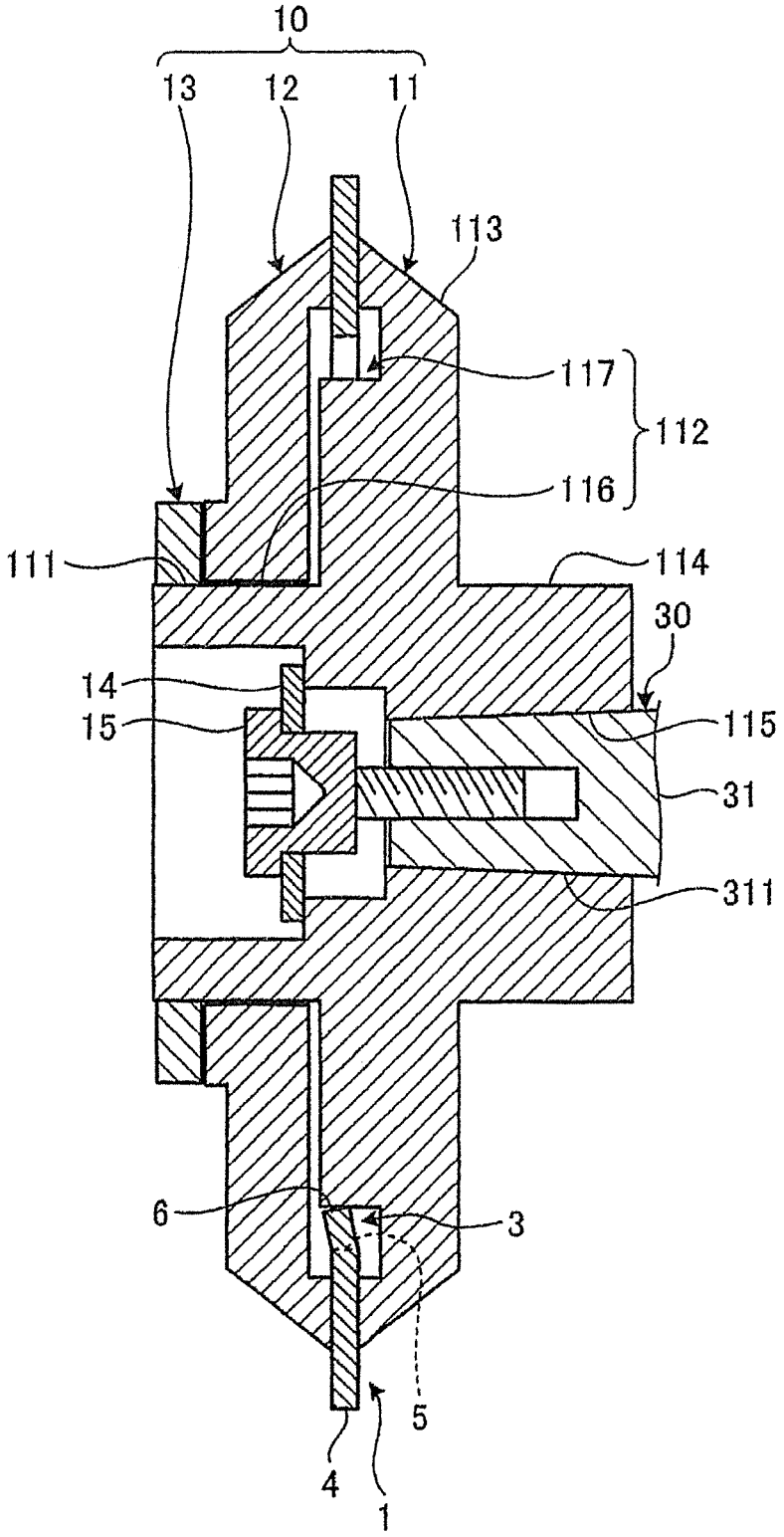
FIG. 3 is a cross sectional view of the mounting mechanism for a cutting blade according to the first embodiment.

As depicted in FIG. 2, the mounting mechanism 10 includes a fixed flange 11, a removable flange 12 and a fixation nut 13. The fixed flange 11 is fixed to the distal end 311 of the spindle 31 and supports the cutting blade 1 thereon. The fixed flange 11 is made of metal. The fixed flange 11 integrally includes a blade mounting portion 112 having a male thread 111 on an outer circumference thereof, a flange portion 113 formed thereon on the spindle housing 32 side behind the blade mounting portion 112, and a cylindrical portion 114 (depicted in FIG. 3) formed thereon on the spindle housing 32 side behind the flange portion 113. Further, as depicted in FIG. 3, the fixed flange 11 has provided over the flange portion 113 and the cylindrical portion 114 therein an insertion hole 115 into the inside of which the distal end 311 of the spindle 31 is to be inserted. The insertion hole 115 has an inner diameter that gradually decreases from the cylindrical portion 114 toward the flange portion 113. The inner circumferential face of the insertion hole 115 is formed in a tapering shape having an inclination same as that of the outer circumferential face of the distal end 311 such that it contacts closely over the overall length with the outer circumferential face of the distal end 311 of the spindle 31 inserted in the insertion hole 115.

The blade mounting portion 112 has an appearance formed cylindrically and has an inner side formed cylindrically so as to communicate with the insertion hole 115. The blade mounting portion 112 includes a cylindrical small diameter portion 116 and an annular blade supporting portion 117 formed on the spindle housing 32 side behind the small diameter portion 116. The small diameter portion 116 has an outer diameter fixed over the overall length thereof in the axial direction and has the male thread 111 provided on an outer face thereof. The outer diameter of the blade supporting portion 117 is greater than the outer diameter of the small diameter portion 116. The blade supporting portion 117 is fitted inside the cutting blade 1 and supports the cutting blade 1 on an outer circumferential face thereof.

The flange portion 113 is formed annularly and has an outer diameter formed greater than the outer diameter of the blade supporting portion 117 of the mounting portion 112. The cylindrical portion 114 has an outer diameter formed equally to the outer diameter of the small diameter portion 116 but formed with a smaller diameter than those of the blade supporting portion 117 and the flange portion 113.

The fixed flange 11 is fixed to the distal end 311 of the spindle 31 such that the distal end 311 of the spindle 31 is fitted in the insertion hole 115 and a bolt 15 passing the inside of a washer 14 is threaded into the distal end 311 of the spindle 31.

The removable flange 12 is formed annularly and made of metal. The inner diameter of the removable flange 12 is substantially equal to the outer diameter of the small diameter portion 116 of the blade mounting portion 112 of the fixed flange 11. The removable flange 12 has the small diameter portion 116 of the blade mounting portion 112 inserted in the inside thereof such that it cooperates with the flange portion 113 of the fixed flange 11 to sandwich the cutting blade 1 therebetween.

The fixation nut 13 is formed annularly and made of metal and has an inner circumferential face on which a female thread 131 is formed such that it is screwed with the male thread 111 provided on the outer circumferential face of the small diameter portion 116 of the blade mounting portion 112 of the fixed flange 11. The fixation nut 13 is screwed at the female thread 131 thereof with the male thread 111 to cooperate with the flange portion 113 of the fixed flange 11 to sandwich and fix the cutting blade 1 and the removable flange 12 therebetween. In this manner, the fixation nut 13 is screwed with the male thread 111 of the fixed flange 11 to sandwich and fix the cutting blade 1 between the fixed flange 11 and the removable flange 12 as depicted in FIG. 3.

Figure 4:
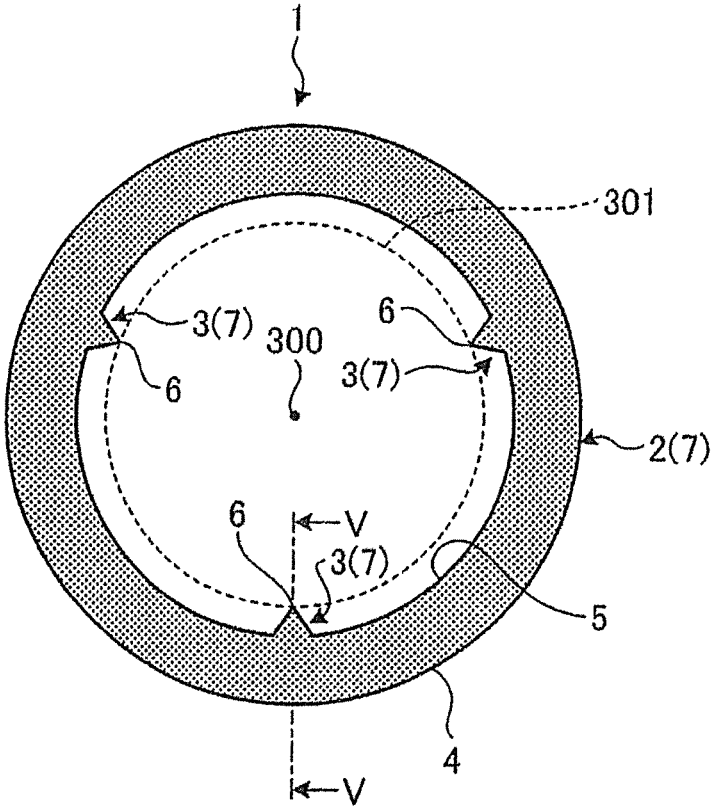
FIG. 4 is a plan view of the cutting blade according to the first embodiment.

The cutting blade 1 has an annular shape and is mounted on the fixed flange 11 with being fixed to the distal end 311 of the spindle 31 by the mounting mechanism 10. The cutting blade 1 is a washer blade (also called hubless blade) and integrally incudes an annular blade main body 2 and three or more flexible inner circumferential protrusions 3 as depicted in FIG. 4.

The blade main body 2 includes an outer circumference 4 serving as a cutting edge, and a central through-hole 5 that has a diameter (inner diameter) greater than the outer diameter of the blade supporting portion 117 of the blade mounting portion 112 of the fixed flange 11 and in the inside of which the blade supporting portion 117 of the blade mounting portion 112 is fitted. The outer circumference 4 and the central through-hole 5 have circular planar shapes and are disposed at positions coaxial with each other (positions at which the centers coincide with each other).

The inner circumferential protrusions 3 are disposed at equal distances in a circumferential direction of the blade main body 2 and project toward the center 300 of a circle defined by the outer circumference 4 of the blade main body 2 along diametrical direction from the inner circumference of the central through-hole 5. It is to be noted that, in the first embodiment, three inner circumferential protrusions 3 are provided, and each of the inner circumferential protrusions 3 is formed, as viewed in plan of the cutting blade 1, in a triangular shape having a width that gradually decreases from the inner circumference of the central through-hole 5 toward the center of the blade main body 2 as depicted in FIG. 4.

Figure 5:
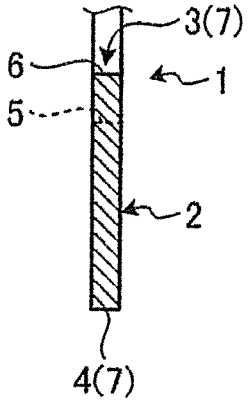
FIG. 5 is a sectional view taken along line V-V of FIG. 4.

Further, each inner circumferential protrusion 3 is formed with a thickness equal to that of the blade main body 2 as depicted in FIG. 5. It is to be noted that, in the first embodiment, the projection amount of each inner circumferential protrusion 3 from the inner circumference of the central through-hole 5 of the blade main body 2 toward the center 300 is approximately 3 to 4 mm, and the thickness of the cutting blade 1 is as thin as approximately 0.03 to 1.00 mm. It is to be noted that, although, in FIGS. 3 and 5, the boundary between the blade main body 2 and the inner circumferential protrusions 3 is indicated by a broken line, actually such a boundary as just described does not exist.

Further, as viewed in plan, a circle 301 indicated by a broken line in FIG. 4 interconnecting extremities 6 of the inner circumferential protrusions 3 on the center 300 side and a circle defined by the outer circumference 4 that serves as a cutting edge of the blade main body 2 are formed concentric circles. The center of the circle 301 interconnecting the extremities 6 of the inner circumferential protrusions 3 on the center 300 side coincides with the center 300 of the outer circumference 4. Further, the diameter of the circle 301 interconnecting the extremities 6 of the inner circumferential protrusions 3 on the center 300 side is smaller than the outer diameter of the blade supporting portion 117 of the blade mounting portion 112 of the fixed flange 11.

In the cutting blade 1 of the configuration described above, the blade main body 2 and the inner circumferential protrusions 3 are configured by bonding abrasive grains of diamond, CBN (Cubic Boron Nitride) or the like with a bond. As the bond for configuring the cutting blade 1, resin bond, metal bond, vitrified bond or electroformed bond is used. In other words, the cutting blade 1 is a resin blade, a metal blade, a vitrified blade or an electroformed blade.

It is to be noted that a resin blade, a metal blade and a vitrified blade are produced by mixing powder of the bond, abrasive grains and so forth, molding the mixture into a predetermined shape, sintering or firing the molded article and then processing the molded article into a predetermined size by a grinding machine or the like. An electroformed blade is produced by a known electroforming method of dispersing abrasive grains into metal plating solution, which configures bond and includes metal as a principal component, disposing base metal into the metal plating solution such that the metal configuring the bond is precipitated to a predetermined thickness on the surface of the base metal while abrasive grains are taken in, exfoliating the precipitated metal configuring the bond from the base metal and shaping the metal into a predetermined shape. In this manner, in the first embodiment, the cutting blade 1 is configured from an abrasive grain layer 7, in which the abrasive grains are fixed by the bond, over the blade main body 2 and the inner circumferential protrusion 3.

Since the cutting blade 1 of the configuration described above is produced by the production method described above and besides has a thickness as small as approximately 0.3 mm, the inner circumferential protrusions 3 themselves have flexibility such that the extremities 6 thereof are displaced in the axial direction. It is to be noted that that the inner circumferential protrusions 3 have flexibility in the present invention indicates that the inner circumferential protrusions 3 themselves are deformable. Further, the inner circumferential protrusions 3 of the cutting blade 1 described above press and are deformed at the extremities 6 thereof against and by the outer circumferential face of the blade supporting portion 117 of the blade mounting portion 112 of the fixed flange 11 fitted in the central through-hole 5 to support the blade main body 2.

When the cutting blade 1 of the configuration described above is to be mounted on the fixed flange 11, the blade mounting portion 112 of the fixed flange 11 is fitted into the central through-hole 5. When the cutting blade 1 of the configuration described above is to be mounted on the fixed flange 11, the inner circumferential protrusions 3 are deformed by contact with the blade supporting portion 117 of the blade mounting portion 112 being fitted such that the extremities 6 are directed toward the removable flange 12 as depicted in FIG. 3 to support the blade main body 2 and permit fitting of the blade mounting portion 112. It is to be noted that, when the cutting blade 1 is to be mounted on the fixed flange 11, all inner circumferential protrusions 3 are deformed similarly such that the center 300 of the circle defined by the outer circumference 4 serving as a cutting edge is registered with the center of rotation of the spindle 31 (namely, such that the displacement between the center 300 of the circle defined by the outer circumference 4 and the center of rotation of the spindle 31 can be suppressed). After the cutting blade 1 is mounted on the distal end 311 of the spindle 31, in the perfect circle establishing step for making the center 300 of the outer circumference 4 serving as a cutting edge and the center of rotation of the spindle 31 coincide with each other, the outer circumference 4 of the cutting blade 1 is forcibly exhausted.

Further, while, in the first embodiment, the cutting blade 1 is subjected to the perfect circle establishing step after the cutting blade 1 is mounted on the distal end 311 of the spindle 31, according to the present invention, only a dressing step for cutting a dressing board for dressing to cause the abrasive grains to project from the bond may be carried out without carrying out the perfect circle establishing step. Since the amount by which the dressing step exhausts the cutting blade 1 is smaller than that by the perfect circle establishing step and is an exhaustion amount of approximately ½ to ⅓, to carry out only the dressing step without carrying out the perfect circle establishing step can suppress the amount by which the cutting blade 1 is forcibly exhausted before a workpiece is cut after the cutting blade 1 is mounted on the spindle 31.

The cutting blade 1 according to the first embodiment has an advantageous effect that, since the circle 301 that interconnects the extremities 6 of the inner circumferential protrusions 3 projecting from the inner circumference of the central through-hole 5 of the blade main body 2 is concentric with the circle defined by the outer circumference 4 that serves as a cutting edge, if the cutting blade 1 is mounted while the inner circumferential protrusions 3 contact with the outer circumferential face of the blade supporting portion 117 of the blade mounting portion 112 of the fixed flange 11, then displacement between the center 300 of the circle defined by the outer circumference 4 and the center of rotation of the spindle 31 can be suppressed. Therefore, according to the cutting blade 1, the amount by which the outer circumference 4 of the cutting blade 1 is exhausted forcibly at the perfect circle establishing step for making the center 300 of the circle defined by the outer circumference 4 serving as a cutting edge after the cutting blade 1 is mounted on the spindle 31 and the center of rotation of the spindle 31 coincide with each other can be suppressed. As a result, according to the cutting blade 1, the amount by which the cutting blade 1 is exhausted forcibly before cutting of a workpiece after the cutting blade 1 is mounted on the spindle 31 can be suppressed.

Further, since the inner circumferential protrusions 3 of the cutting blade 1 are deformable, all inner circumferential protrusions 3 are deformed similarly with respect to the blade mounting portion 112, and consequently, the cutting blade 1 has an advantageous effect that the exhaustion amount of the cutting blade 1 at the perfect circle establishing step can be suppressed while the cutting blade 1 is supported with certainty.

Further, the mounting mechanism 10 according to the first embodiment has an advantageous effect that, since the cutting blade 1 described above is mounted on the distal end 311 of the spindle 31, the amount by which the outer circumference 4 of the cutting blade 1 is exhausted forcibly in the perfect circle establishing step can be suppressed.

Second Embodiment

Figure 6:
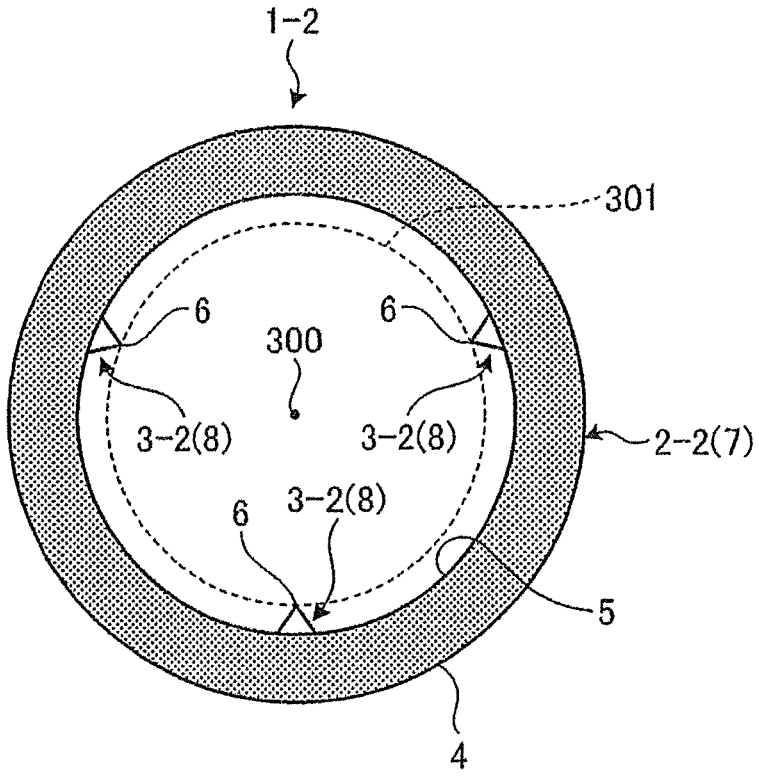
FIG. 6 is a plan view of a cutting blade according to a second embodiment.

A cutting blade according to a second embodiment is described with reference to FIG. 6. FIG. 6 is a plan view of the cutting blade according to the second embodiment. It is to be noted that, in FIG. 6, the same elements as those of the first embodiment are denoted by the same reference numerals.

A cutting blade 1-2 depicted in FIG. 6 according to the second embodiment is same in configuration as the cutting blade 1 of the first embodiment except that a blade main body 2-2 is configured from an abrasive grain layer 7 and inner circumferential protrusions 3-2 are formed from a bond layer 8 that does not include abrasive grains. The bond layer 8 is configured from bond configuring the blade main body 2-2 and does not include abrasive grains.

In the case where the cutting blade 1-2 according to the second embodiment is a resin blade, a metal blade or a vitrified blade, it is produced such that, after powder of bond, abrasive grains and so forth are mixed to mold a blade main body 2-2 and inner circumferential protrusions 3-2 are molded from powder of the bond or the like, the molded article is sintered or fired and then processed to a predetermined size by a grinding machine or the like. In the case where the cutting blade 1-2 is an electroformed blade, it is produced by a known electroforming method of dispersing abrasive grains into metal plating solution, which configures bond and includes metal as a principal component, disposing base metal into the metal plating solution such that the metal configuring the bond is precipitated on the surface of the base metal while abrasive grains are taken in to form a blade main body 2-2, disposing base metal into metal plating solution in which abrasive grains are not dispersed such that the metal configuring the bond is precipitated to form inner circumferential protrusions 3-2, exfoliating the precipitated metal configuring the bond from the base metal and shaping the metal into a predetermined shape.

The cutting blade 1-2 according to the second embodiment is mounted on the distal end 311 of the spindle 31 by the mounting mechanism 10 according to the first embodiment. The cutting blade 1-2 according to the second embodiment has an advantageous effect that, since the circle 301 that interconnects the extremities 6 of the inner circumferential protrusions 3-2 projecting from the inner circumference of the central through-hole 5 of the blade main body 2-2 is concentric with the circle defined by the outer circumference 4 that serves as a cutting edge, the amount by which the outer circumference 4 of the cutting blade 1-2 is forcibly exhausted at the perfect circle establishing step can be suppressed similarly as in the first embodiment. Further, with the cutting blade 1-2 according to the second embodiment, since the inner circumferential protrusions 3-2 do not include abrasive grains, the blade supporting portion 117 of the mounting mechanism 10 is not damaged by abrasive grains.

Modification 1

Figure 7:
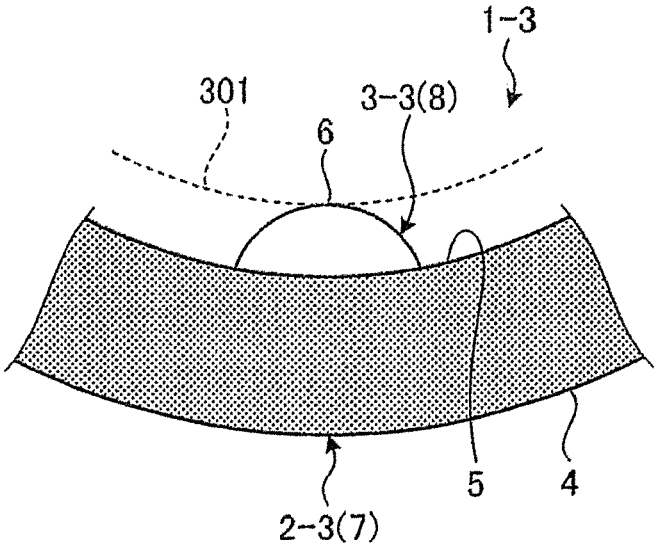
FIG. 7 is a plan view of part of a cutting blade according to a modification 1 to the first and second embodiments.

A cutting blade according to a modification 1 to the first and second embodiments is described with reference to the drawings. FIG. 7 is a plan view of part of the cutting blade according to the modification 1 to the first and second embodiments. It is to be noted that, in FIG. 7, the same elements as those in the first and second embodiments are denoted by the same reference numerals.

A cutting blade 1-3 depicted in FIG. 7 according to the modification 1 is same in configuration as the first and second embodiments except that inner circumferential protrusions 3-3 are formed in a semicircular shape whose width gradually decreases from the inner circumference of the central through-hole 5 toward the center 300. It is to be noted that, while FIG. 7 depicts an example in which a blade main body 2-3 is configured from an abrasive grain layer 7 and the inner circumferential protrusions 3-3 are formed from a bond layer 8 similarly to the cutting blade 1-2 according to the second embodiment, in the present invention, the blade main body 2-3 and the inner circumferential protrusions 3-3 may be configured from an abrasive grain layer 7 similarly as in the first embodiment. The cutting blade 1-3 according to the modification 1 is mounted on the distal end 311 of the spindle 31 by the mounting mechanism 10 according to the first embodiment.

The cutting blade 1-3 according to the working example 1 has an advantageous effect that, since the circle 301 that interconnects the extremities 6 of the inner circumferential protrusions 3-3 projecting from the inner circumference of the central through-hole 5 of the blade main body 2-3 is concentric with the circle defined by the outer circumference 4 that serves as a cutting edge, the amount by which the outer circumference 4 of the cutting blade 1-3 is forcibly exhausted at the perfect circle establishing step can be suppressed similarly as in the first embodiment.

Modification 2

Figure 8:
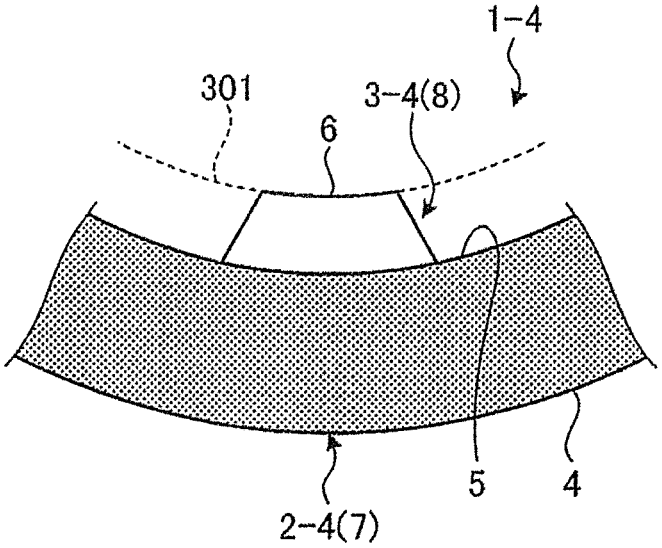
FIG. 8 is a plan view of part of a cutting blade according to a modification 2 to the first and second embodiments.

A cutting blade according to a modification 2 to the first and second embodiments is described with reference to the drawings. FIG. 8 is a plan view of part of the cutting blade according to the modification 2 to the first and second embodiments. It is to be noted that, in FIG. 8, the same elements as those in the first and second embodiments are denoted by the same reference numerals.

A cutting blade 1-4 depicted in FIG. 8 according to the modification 2 is same in configuration as the first and second embodiments except that inner circumferential protrusions 3-4 are formed in a trapezoidal shape such that, as viewed in plan, the width thereof gradually decreases from the inner circumference of the central through-hole 5 toward the center 300. It is to be noted that, while FIG. 8 depicts an example in which a blade main body 2-4 is configured from an abrasive grain layer 7 and the inner circumferential protrusions 3-4 are formed from a bond layer 8 similarly to the cutting blade 1-2 according to the second embodiment, in the present invention, the blade main body 2-4 and the inner circumferential protrusions 3-4 may be configured from an abrasive grain layer 7 similarly as in the first embodiment. The cutting blade 1-4 according to the modification 2 is mounted on the distal end 311 of the spindle 31 by the mounting mechanism 10 according to the first embodiment.

The cutting blade 1-4 according to the modification 2 has an advantageous effect that, since the circle 301 that interconnects the extremities 6 of the inner circumferential protrusions 3-4 projecting from the inner circumference of the central through-hole 5 of the blade main body 2-4 is concentric with the circle defined by the outer circumference 4 that serves as a cutting edge, the amount by which the outer circumference 4 of the cutting blade 1-4 is forcibly exhausted at the perfect circle establishing step can be suppressed similarly as in the first embodiment. It is to be noted that the present invention is not limited to the embodiments and the modifications. In particular, the present invention can be carried out in various modified forms without departing from the scope and spirit of the present invention.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A cutting blade of an annular shape for being mounted on a fixed flange having a cylindrical blade mounting portion fixed to a distal end of a spindle, comprising:

an annular blade main body having an outer circumference serving as a cutting edge, a central through-hole that has a diameter greater than a uniform outer diameter of the blade mounting portion having a uniform cylindrical surface and in which the blade mounting portion is to be fitted, and an uninterrupted surface extending from the central through-hole to the outer circumference; and three or more flexible inner circumferential protrusions that project monolithically from an inner circumference of the central through-hole toward the center in a diametrical direction and contact at extremities thereof with the blade mounting portion fitted in the central through-hole to support the blade main body, wherein as viewed in plan, a circle interconnecting the extremities of the inner circumferential protrusions and a circle defined by the outer circumference of the blade main body are formed concentrically, and when the cutting blade is mounted on the fixed flange, the inner circumferential protrusions are configured to be deformed by pressure contact with the uniform cylindrical surface of the blade mounting portion into which the cutting blade is fitted to allow the fitting of the cutting blade with the blade mounting portion.

2. The cutting blade according to claim 1, wherein the blade main body is configured from an abrasive grain layer in which abrasive grains are fixed by bond, and the inner circumferential protrusions are formed from a bond layer that does not include abrasive grains.

3. A cutting appartus comprising:

a cutting blade including an annular blade main body having an outer circumference serving as a cutting edge and a central through-hole, and three or more flexible circumferential protrusions formed integrally with the annular blade main body and projecting from an inner circumference of the central through-hole toward the center in a diametrical direction; and a mounting mechanism including a fixed flange including a blade mounting portion fixed to a distal end of a spindle of a cutting apparatus and having a male thread on an outer circumference thereof and a flange portion formed integrally with the blade mounting portion behind the blade mounting portion, the flange portion having a smooth uniform surface along an entire face of the flange portion;

a removable flange configured to be mounted on the blade mounting portion and having a body portion and a face portion protruding from the body portion, the face portion being configured so as to cooperate with the face of the flange portion of the fixed flange to sandwich therebetween a cutting blade mounted on the blade mounting portion of the fixed flange and to create a space between the body portion and the cutting blade; and a fixation nut configured to be screwed with the male thread of the fixed flange such that the cutting blade is sandwiched and fixed between the flange portion of the fixed flange and the face portion of the removable flange, wherein, a diameter of the blade mounting portion is smaller than a diameter of the central through-hole of the blade main body, and when the fixation nut is screwed with the male thread of the fixed flange and tightened, the inner circumferential protrusions are pressed against and deformed by the blade mounting portion to be directed into a space created by the face portion of the removable flange, a gap is created between the central through-hole and the blade mounting portion, and the annular blade main body is supported by the inner circumferential protrusions.

4. The cutting blade according to claim 1, wherein the circumferential protrusions are formed in a triangular shape.

5. The cutting blade according to claim 1, wherein the circumferential protrusions are formed in a semicircular shape.

6. The cutting blade according to claim 1, wherein the circumferential protrusions are formed in a trapezoidal shape.

7. The cutting apparatus according to claim 3, wherein the face portion of the removable flange has a smooth uniform surface along an entire face of the face portion.

8. The cutting blade according to claim 1, wherein the inner circumferential protrusions are configured to be deformed such that the extremities of the inner circumferential protrusions are directed towards the distal end of the spindle.

* * * * *